US008592706B2

(12) United States Patent
Prince et al.

(10) Patent No.: US 8,592,706 B2
(45) Date of Patent: Nov. 26, 2013

(54) CHARGING HANDLE APPARATUS AND SWITCHGEAR APPARATUS

(75) Inventors: Edward Anthony Prince, Aliquippa, PA (US); Nathan James Weister, Beaver, PA (US); Robert Michael Slepian, Murrysville, PA (US); David Allen Parks, Baden, PA (US); William David Munsch, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 316 days.

(21) Appl. No.: 12/881,448

(22) Filed: Sep. 14, 2010

(65) Prior Publication Data

US 2012/0061219 A1 Mar. 15, 2012

(51) Int. Cl.
*H01H 5/00* (2006.01)

(52) U.S. Cl.
USPC ..... 200/400

(58) Field of Classification Search
USPC ..... 200/400
See application file for complete search history.

(56) References Cited

U.S. PATENT DOCUMENTS

| | | | | |
|---|---|---|---|---|
| 5,274,206 | A * | 12/1993 | Milianowicz | 200/400 |
| 6,160,234 | A | 12/2000 | Wehrli, III et al. | |
| 7,518,076 | B1 | 4/2009 | Gottschalk et al. | |

FOREIGN PATENT DOCUMENTS

| | | | |
|---|---|---|---|
| DE | 298 24 498 | U1 | 3/2001 |
| EP | 0 873 822 | A2 | 10/1998 |
| EP | 1 968 091 | A2 | 9/2008 |

OTHER PUBLICATIONS

European Patent Office, "International search report and Written Opinion", Jan. 31, 2012, 13 pp.

* cited by examiner

*Primary Examiner* — Renee Luebke
*Assistant Examiner* — Lheiren Mae Caroc
(74) *Attorney, Agent, or Firm* — Eckert Seamans Cherin & Mellott, LLC; Brij K. Agarwal

(57) ABSTRACT

A charging handle apparatus includes a two-piece support apparatus that is disposed on a handle assembly and that is engaged with a gear. One of the two pieces is movable with respect to the first piece. The second piece of the support apparatus includes a number of engagement structures that are engaged with the gear and that retain the gear in a given position with respect to the handle assembly. The charging handle apparatus thus can be provided as a pre-assembled component that is readily mountable to a shaft of a circuit interrupter.

18 Claims, 7 Drawing Sheets

CHARGING HANDLE APPARATUS AND SWITCHGEAR APPARATUS

BACKGROUND

1. Field

The disclosed and claimed concept relates generally to circuit interruption equipment and, more particularly, to an improved charging handle apparatus for use in a circuit breaker.

2. Related Art

Circuit interruption equipment is generally known for use in interrupting at least a portion of an electrical circuit in certain overcurrent and under-voltage conditions, as well as other conditions. Circuit interruption equipment typically can include a circuit interrupter such as a circuit breaker, and the circuit breaker can be mounted on a switchgear cabinet or other mounting structure, although this is not strictly required. Depending upon the current interruption capability of the circuit breaker, the circuit breaker may include an operating mechanisms having springs that are of a sufficient stiffness that in order to manually recharge them the springs are compressed with a ratcheting type of handle that is mounted to a housing of the circuit breaker and that is manually pivotable to mechanically charge the operating mechanisms. While such system have been generally effective for mechanically charging the operating mechanism of a circuit breaker, such systems have not been without limitation.

Ratcheting handles such as those mentioned above often operate cooperatively with a gear and a shaft to mechanically charge the operating mechanism of the circuit breaker. If the gear is improperly installed with respect to the handle or shaft or both, such as if the gear is installed in a reverse direction from what is correct, the system must be disassembled and the orientation of the gear must be corrected. Moreover, since the gear and the handle cooperate with a shaft, the gear and the handle typically cannot be pre-assembled except when provided in conjunction with an assembled circuit breaker. The inability of the gear to be pre-assembled with the handle can cause the gear to become lost during assembly and can also exacerbate the problem of installing the gear in the correct orientation as mentioned above. It thus would be desirable to provide an improved charging handle apparatus and circuit breaker that meet these and other needs.

SUMMARY

These and other needs are met by an improved charging handle apparatus and circuit breaker in accordance with the disclosed and claimed concept. The charging handle apparatus includes a two-piece support apparatus that is disposed on a handle assembly and that is engaged with a gear. More particularly, one of the two pieces of the support apparatus is disposed on the handle assembly, and the other of the two pieces is engaged with the gear and is movable with respect to the first piece. The second piece of the support apparatus includes a number of engagement structures that are engaged with the gear and that retain the gear in a given position with respect to the handle assembly. The charging handle apparatus thus can be provided as a pre-assembled component that is readily mountable to a shaft of a circuit breaker.

Accordingly, an aspect of the disclosed and claimed concept is to provide an improved charging handle apparatus and circuit breaker wherein a gear of the charging handle apparatus cannot be in an improperly installed configuration.

Another aspect of the disclosed and claimed is to provide an improved charging handle apparatus in which the gear can be preassembled to avoid loss and to avoid improper orientation of the gear during installation of the charging handle apparatus into a circuit breaker.

These and other aspects of the disclosed and claimed concept are provided by an improved charging handle apparatus for use in a circuit interrupter to mechanically charge an operating mechanism of the circuit interrupter. The charging handle apparatus can be generally stated as including a handle assembly, a gear structured to be mechanically connected with a portion of the operating mechanism, and a support apparatus disposed on the handle assembly and engaged with the gear. The support apparatus comprises a base portion and an engagement portion. The base portion is disposed on the handle assembly, and the engagement portion is disposed on the base portion and engaged with the gear. At least one of the base portion and the engagement portion is movable with respect to the other of the base portion and the engagement portion.

Other aspects of the disclosed and claimed concept are provided by an improved circuit interrupter, the general nature of which can be stated as including a housing, an operating mechanism disposed on the housing, and the charging handle apparatus as set forth above, the charging handle apparatus being mechanically connected with the operating mechanism to mechanically charge the operating mechanism.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 2:
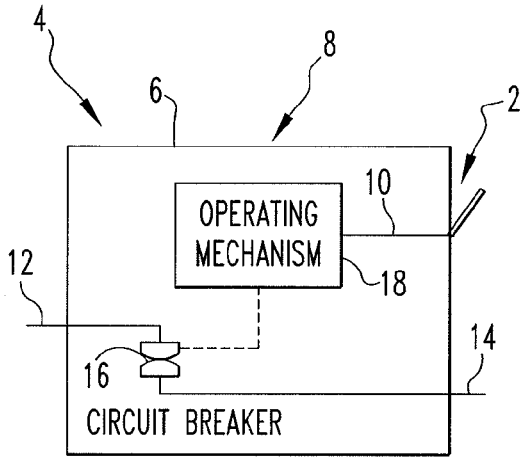
FIG. 2 is a schematic depiction of an improved circuit breaker in accordance with the disclosed and claimed concept that includes the improved charging handle apparatus of FIG. 1.
Figure 1:
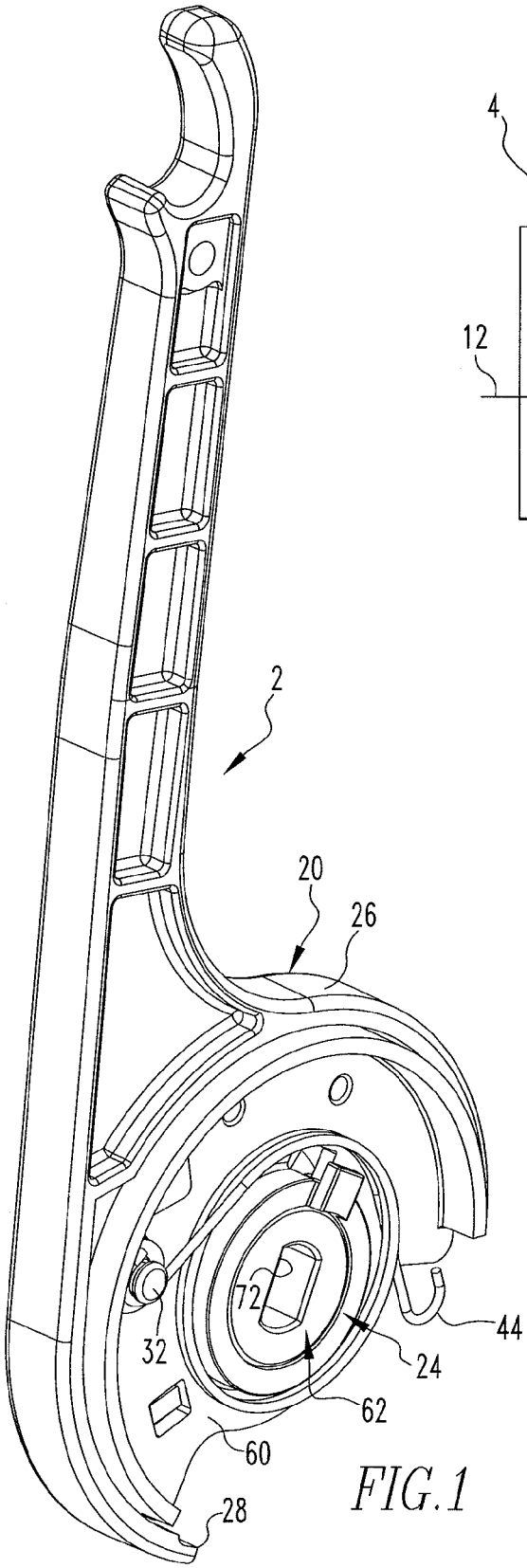
FIG. 1 is a perspective view of an improved charging handle apparatus in accordance with the disclosed and claimed concept.
Figure 3:
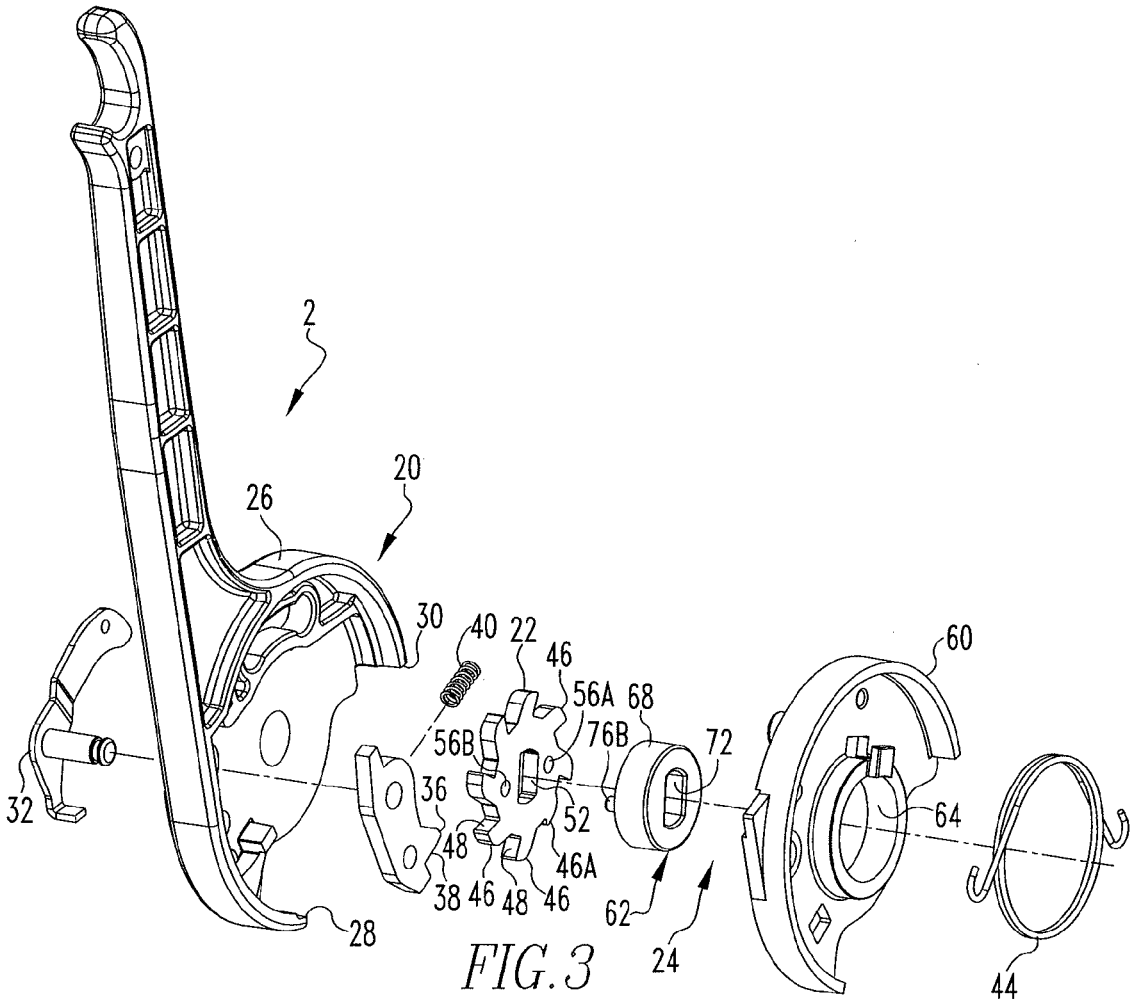
FIG. 3 is an exploded view of the charging handle apparatus of FIG. 1.

An improved charging handle apparatus 2 in accordance with the disclosed and claimed concept is depicted generally in FIGS. 1 and 3, is depicted schematically in FIG. 2, and is depicted in part in FIGS. 4-10. The improved charging handle apparatus 2 can be beneficially incorporated into an improved circuit interrupter such as the circuit breaker 8 depicted in FIG. 2.

The circuit breaker 8 comprises, in a known fashion, a housing 6 upon which are disposed a line conductor 12 and a load conductor 14 that are connected by a set of separable contacts 16. The circuit breaker 8 further comprises an operating mechanism 18 that is disposed on the housing 6 and is operable to separate and connect together the set of separable contacts 16 in certain predefined circumstances. The operating mechanism 18 comprises springs or other structures that are compressed or otherwise mechanically energized by a technician to mechanically charge the operating mechanism 18.

The circuit breaker 8 further comprises the charging handle apparatus 2. The operating mechanism comprises 18 a shaft 10 that mechanically extends between the operating mechanism 18 and the charging handle apparatus 2 to mechanically connect the charging handle apparatus 2 with the operating mechanism 18, and to thereby allow the charging handle apparatus 2 to be operated by a technician to mechanically charge the operating mechanism 18. The charging handle apparatus 2 is disposed in one fashion or another on the housing 6 of the circuit breaker 8 and, in the embodiment depicted herein, is mounted to a plate 78 such as will be discussed below that is disposed on the housing 6.

As can be understood from FIG. 3, the charging handle apparatus 2 comprises a handle assembly 20, a gear 22, and a support apparatus 24. The support apparatus 24 is disposed on the handle assembly 20 and is engaged with the gear 22 to retain at least a portion of the gear 22 between at least a portion of the handle assembly 20 and at least a portion of the support apparatus 24. The handle assembly 20 itself comprises a handle member 26 having a first stop 28 and a second stop 30, a release lever 32, a movable pawl 36 having a pawl engagement surface 38, a pawl spring 40, and a return spring 44.

The gear 22 comprises a plurality of teeth 46, of which one is a short tooth 46A. Each of the teeth 46 comprises a tooth engagement surface 48. The tooth engagement surfaces 48 are each separately engageable with the pawl engagement surface 38, although it is noted that the tooth engagement surface 48A of the short tooth 46A is configured to not be engageable with the pawl engagement surface 38. The gear 22 has formed generally centrally therein an opening 52 that is non-cylindrical and asymmetrical, and further has formed therein a pair of holes 56A and 56B.

The support apparatus 24 is a two-piece apparatus that comprises a base portion 60 and an engagement portion 62. The base portion 60 is itself disposed on the handle member 26 of the handle assembly 20, and the engagement portion 62 is disposed on the base portion 60 and is engaged with the gear 22. It is noted that the base portion 60 comprises a substantially cylindrical first bearing surface 64, and that the engagement portion 62 comprises a substantially cylindrical second bearing surface 68, with the first and second bearing surfaces 64 and 68 being complementary. That is, the first and second bearing surfaces 64 and 68 are slidably engageable with one another, thus permitting the engagement portion 62 to be movable with respect to the base portion 60, and vice versa. While the first and second bearing surfaces 64 and 68 are depicted as being substantially cylindrical, it is noted that in the depicted embodiment the first and second bearing surfaces 64 and 68 are each formed to have a draft angle that is of about 0.5 degrees and that is of no more than about 1.0 degrees. The draft angles enable the base portion 60 to retain the engagement portion 62 engaged with a face of the gear 22 while still permitting the engagement portion 62 to rotate with respect to the base portion 60. While such draft angles are employed in the embodiment depicted herein, it is noted that they are not required and rather could be absent from other embodiments not expressly depicted herein.

Figure 4:
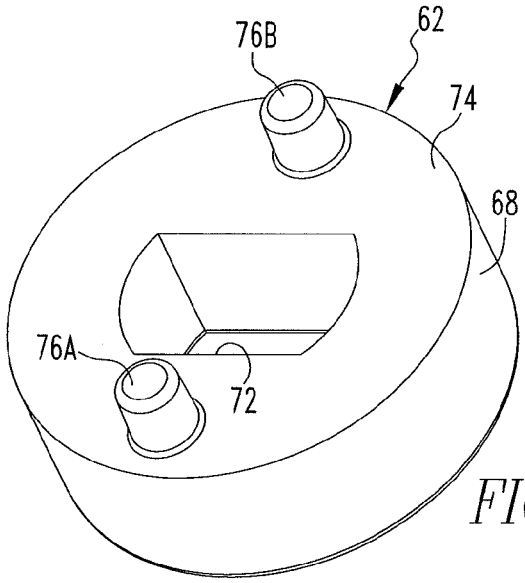
FIG. 4 is a perspective view of a component of the charging handle apparatus of FIG. 1.

As can be understood from FIG. 4, the engagement portion 62 has formed therein an opening 72 that is non-cylindrical and asymmetric, as is the opening 52 formed in the gear 22. The engagement portion 62 further comprises a substantially planar engagement surface 74 out of which protrude a pair of engagement structures 76A and 76B which, in the depicted exemplary embodiment, are in the form of cylindrical pins but that may be other structures without departing from the present concept.

Figure 5:
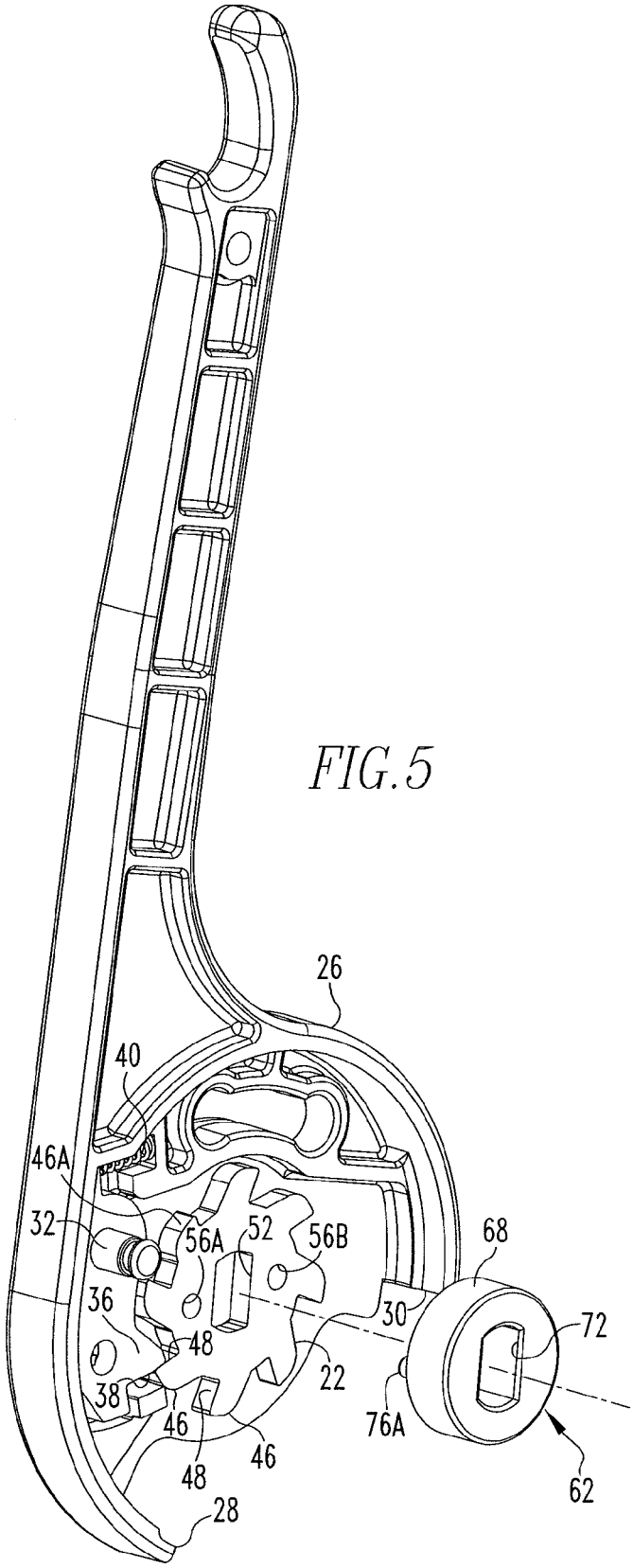
FIG. 5 is a partially exploded view of the charging handle apparatus of FIG. 1.
Figure 6:
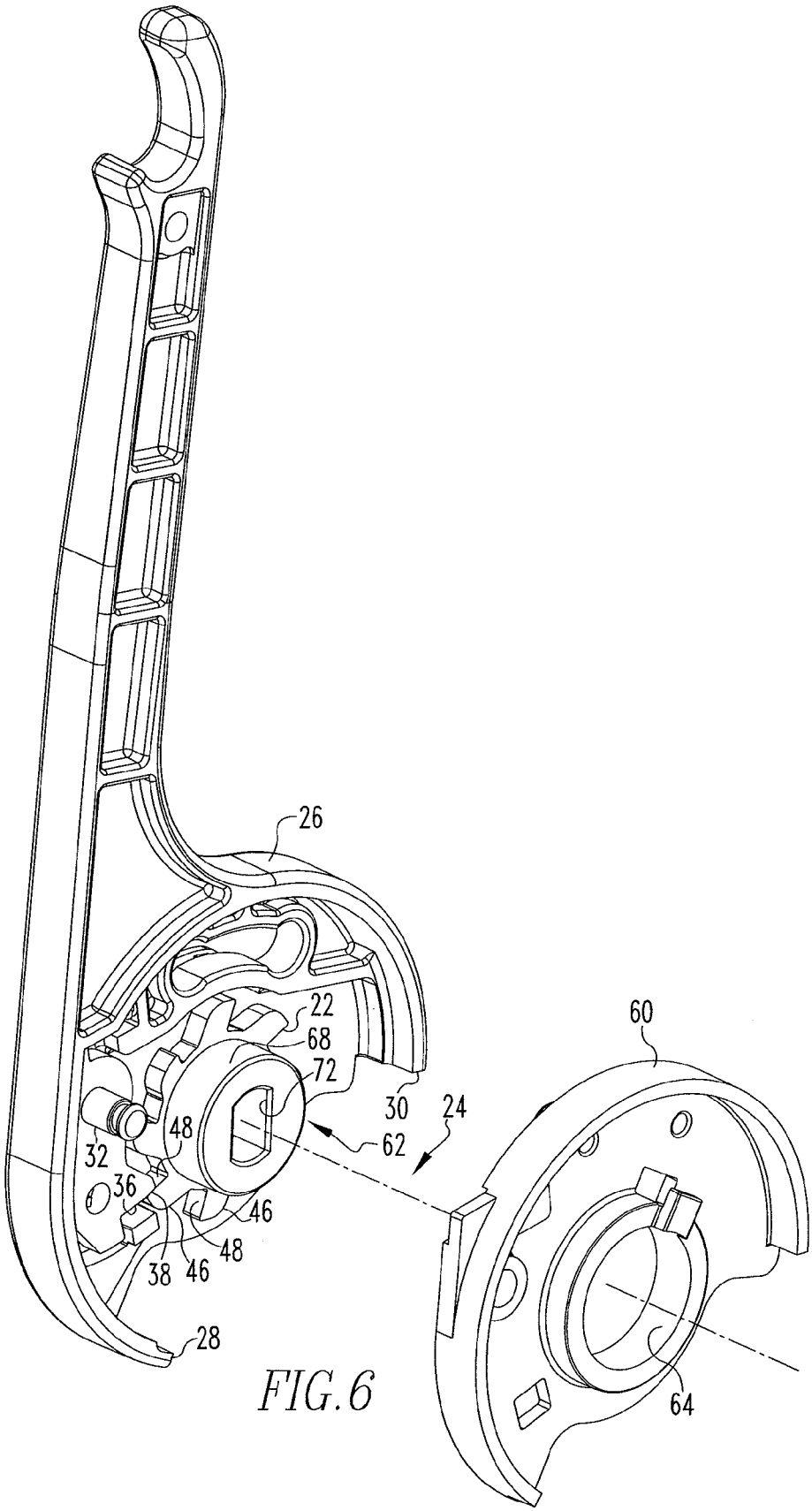
FIG. 6 is another partially exploded view of the charging handle apparatus of FIG. 1.

As can be understood from FIG. 5, the engagement structures 76A and 76B are receivable in the holes 56A and 56B, respectively, of the gear 22. As can be understood from FIG. 6, the base portion 60 is thereafter receivable on the handle member 26 and receives the second bearing surface 68 of the engagement portion 62 in movable engagement with the first bearing surface 64 of the base portion 60.

Figure 7:
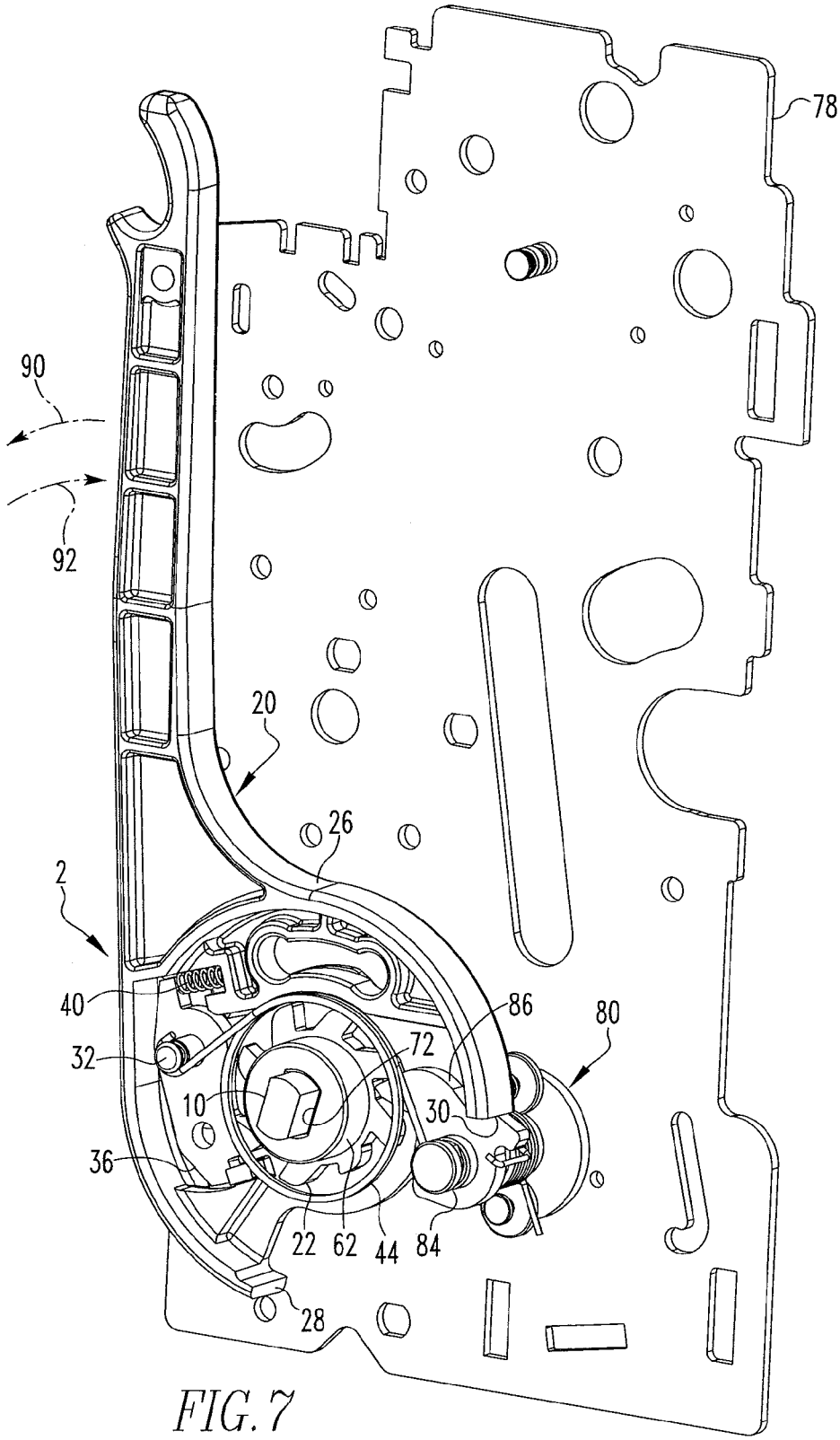
FIG. 7 is a perspective view of the portion of the charging handle apparatus of FIG. 1 mounted to a plate of the circuit breaker of FIG. 2.

As can be understood from FIG. 7, the charging handle apparatus 2 (with the base portion 60 thereof removed for reasons of visual clarity) is mountable to the plate 78 disposed on the housing 6 of the circuit breaker 8 by receiving the shaft 10 through the aligned openings 52 and 72 in the gear 22 and the engagement portion 62, respectively, and by mounting the free ends of the return spring 44 between a pin of the release lever 32 and a pawl pin 84 of a stationary pawl assembly 80. The stationary pawl assembly 80 is mounted to the plate 78 and includes both the pawl pin 84 and a stationary pawl 86 that is engageable with individual ones of the tooth engagement surfaces 48 of the gear 22, including the tooth engagement surface 48A of the short tooth 46A.

As can be understood from FIG. 7, the handle member 26 of the charging handle apparatus 2 can be manually cranked in the direction of the arrow of FIG. 7 designated at the numeral 90 to cause the pawl engagement surface 38 that is engaged with one of the tooth engagement surfaces 48 to rotate the gear 22 and thus the shaft 10 to at least partially mechanically charge the operating mechanism 18 of the circuit breaker 8. Prior to the time that the first stop 28 engages the pawl pin 84, the stationary pawl 86 will have been biased into proximity to a tooth engagement surface 88 to resist mechanically releasing the charging effort that has been transferred to the springs of the operating mechanism 18. The return spring 44 then biases the handle member 26 in a direction indicated by the arrow 92, whereupon the second stop 30 is engageable with the pawl pin 84 to stop motion of the handle member 26 in the direction of the arrow 92.

Figure 8:
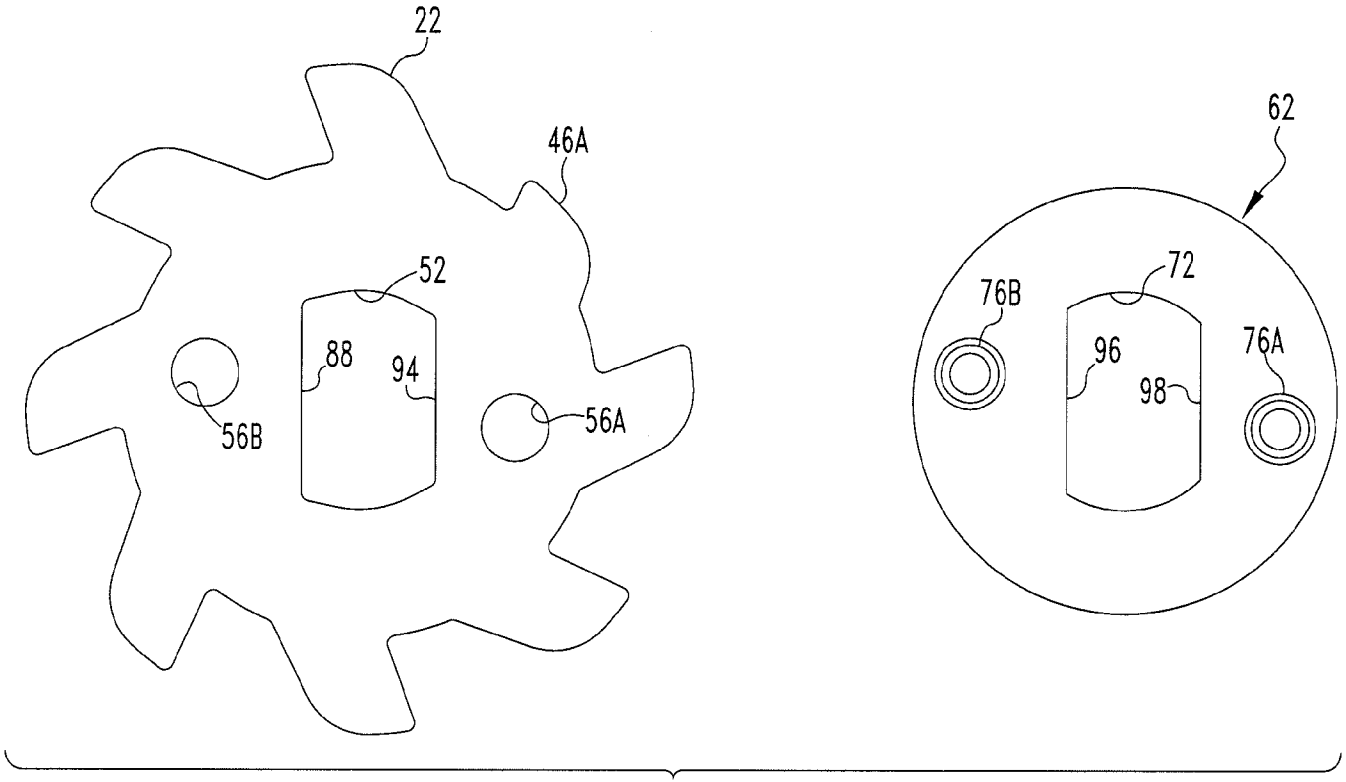
FIG. 8 is a view of a gear and an engagement portion of the charging handle apparatus of FIG. 1 prior to their being assembled together.

As can be seen in FIG. 8, the opening 52 in the gear 22 has a relatively longer side 88 and a relatively shorter side 94. Moreover, the opening 72 in the engagement portion 62 likewise has a relatively longer side 96 and a relatively shorter side 98. If the gear 22 as indicated in FIG. 8 is superimposed over the engagement portion 62 as is likewise depicted in FIG. 8, the engagement structure 76A is received in the hole 56A of the gear 22, the engagement structure 76B is received in the hole 56B. Moreover in such a condition, the openings 52 and 72 are aligned with one another, meaning that the longer sides 88 and 96 of the gear 22 and the engagement portion 62, respectively, overlie one another, and the shorter sides 94 and 98 of the gear 22 and the engagement portion 62, respectively, likewise overlie one another. Such an orientation of the engagement portion 62 engaged with the gear 22 is depicted generally in FIG. 9 and can be referred to as a first orientation of the engagement portion 62 engaged with the gear 22. That is, in FIG. 9 the engagement structure 76A is received in the hole 56A, the engagement structure 76B is received in the hole 56B, and the longer sides 88 and 96 overlie one another as do the shorter sides 94 and 98 from the perspective of FIG. 9. It is noted that the first orientation of the engagement portion 62 and the gear 22 is likewise depicted in various fashions in FIGS. 6, 7, and 9.

Figure 9:
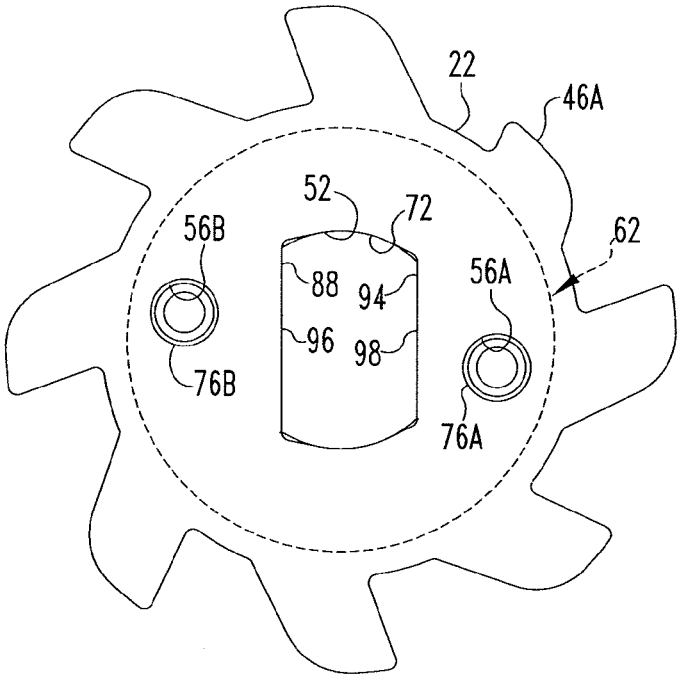
FIG. 9 is a view of the components of FIG. 8 once they have been assembled together in a first orientation.
Figure 10:
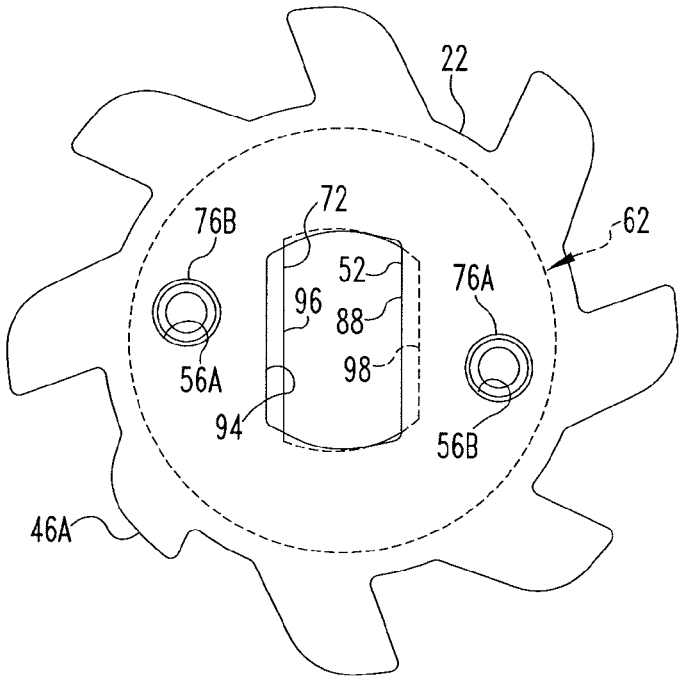
FIG. 10 is an exemplary view of a second orientation of the two components of FIG. 8 assembled together improperly as is indicated by a non-cylindrical opening in each such component being misaligned with one another.

Advantageously, the engagement portion 62 and the gear 22 are configured to enable at most only one orientation, i.e., the first orientation as mentioned above, in which the engagement structures 76A and 76B are received in the holes 56A and 56B and in which the openings 52 and 72 are aligned with one another. For instance, an exemplary second orientation of the engagement portion 62 and the gear 22 is depicted generally in FIG. 10 in which the openings 52 and 72 do not overlie one another, and rather are offset from the perspective of FIG. 10. While the engagement structures 76A and 76B are received in the holes 56A and 56B, it can be seen that the engagement structure 76A is received in the hole 56B and the engagement structure 76B is received in the hole 56A. Notably, the misalignment of the openings 52 and 72 would resist the reception of the shaft 10 therein, which advantageously resists the gear 22 from being assembled into the circuit breaker 8 in an erroneous orientation. That is, as can be seen in FIG. 9, the alignment of the openings 52 and 72 is structured to receive therein the shaft 10 which has a corresponding cross-sectional shape, whereas the improperly oriented engagement portion 62 and gear 22 in the exemplary second orientation of FIG. 10 would resist the entry of the shaft 10 into the openings 52 and 72.

It also can be understood that the engagement structures 76A and 76B received in the holes 56A and 56B, respectively, retain the gear 22 between the engagement surface 74 of the engagement portion 62 and an opposite interior surface of the handle member 26. As such, the charging handle apparatus 2 can be provided as a pre-assembled component which can then be mounted to the shaft 10 of the circuit breaker 8 without any meaningful concern that the gear 22 could be mis-oriented in the fully assembled circuit breaker 8. Such retention of the gear 22 between the support apparatus 24 and the handle member 26 of the handle assembly 20 also resists loss of the gear 22 during assembly of the charging handle apparatus 2 onto the shaft 10, all of which saves time and effort.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A charging handle apparatus for use in a circuit interrupter to mechanically charge an operating mechanism of the circuit interrupter, the charging handle apparatus comprising:

a handle assembly;

a gear structured to be mechanically connected with a portion of the operating mechanism; and a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion; and the base portion and the engagement portion each having substantially cylindrical complementary bearing surfaces that are engaged with one another and that are structured to enable the gear and the engagement portion to be together rotatable with respect to the handle assembly.

2. The charging handle apparatus of claim 1 wherein the engagement portion comprises a number of engagement structures that are engaged with the gear.

3. A charging handle apparatus for use in a circuit interrupter to mechanically charge an operating mechanism of the circuit interrupter, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

the engagement portion comprising a number of engagement structures that are engaged with the gear; and wherein the gear has at least a pair of holes formed therein, and wherein the number of engagement structures comprise at least a pair of pins that are received in the at least pair of holes.

4. The charging handle apparatus of claim 3 wherein the engagement portion comprises a substantially planar engagement surface, the pins protruding from the engagement surface, the engagement surface being engageable with a face of the gear.

5. A charging handle apparatus for use in a circuit interrupter to mechanically charge an operating mechanism of the circuit interrupter, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

the engagement portion comprising a number of engagement structures that are engaged with the gear; and wherein the gear and the engagement portion each have a non-cylindrical opening formed therein, the opening in the gear and the opening in the engagement portion being aligned with one another and structured to receive therethrough a shaft that is mechanically connected with the operating mechanism of the circuit interrupter when the engagement structures are engaged with the gear in a first orientation of the gear and the engagement portion, the opening in the gear and the opening in the engagement portion being at least partially misaligned and structured to resist receiving the shaft therethrough when the engagement structures are engaged with the gear in a second orientation of the gear and the engagement portion different than the first orientation.

6. The charging handle apparatus of claim 5 wherein the handle assembly comprises a pawl having a pawl engagement surface, and wherein the gear includes a plurality of teeth, at least some of which each have a tooth engagement surface, at least some of the tooth engagement surfaces being individually engageable with the pawl engagement surface in the first orientation of the gear and the engagement portion.

7. A charging handle apparatus for use in a circuit interrupter to mechanically charge an operating mechanism of the circuit interrupter, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

the engagement portion comprising a number of engagement structures that are engaged with the gear;

the gear and the engagement portion each have a non-cylindrical opening formed therein;

the handle assembly comprises a pawl having a pawl engagement surface;

the gear includes a plurality of teeth, at least some of which each having a tooth engagement surface; and in at most a first orientation of the engagement of the engagement structures with the gear:

the opening in the gear and the opening in the engagement portion are aligned with one another and are structured to receive therethrough a shaft that is mechanically connected with the operating mechanism of the circuit interrupter, and the pawl engagement surface is engageable with individual ones of the tooth engagement surfaces and is structured to rotate the shaft to charge the operating mechanism of the circuit interrupter.

8. A charging handle apparatus for use in a circuit interrupter to mechanically charge an operating mechanism of the circuit interrupter, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

the engagement portion comprising a number of engagement structures that are engaged with the gear; and wherein the handle apparatus comprises a handle member, and wherein the engagement structures that are engaged with the gear retain the gear between at least a portion of the engagement portion and at least a portion of handle member.

9. A charging handle apparatus for use in a circuit interrupter to mechanically charge an operating mechanism of the circuit interrupter, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

wherein the base portion and the engagement portion have complementary bearing surfaces that are each substantially cylindrical and that are engaged with one another; and wherein the bearing surfaces are formed to each have a draft angle from cylindrical that is no more than about one degree.

10. A circuit interrupter comprising:

a housing;

an operating mechanism disposed on the housing; and a charging handle apparatus mechanically connected with the operating mechanism to mechanically charge the operating mechanism, the charging handle apparatus comprising:

a handle assembly;

a gear structured to be mechanically connected with a portion of the operating mechanism; and a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion; and the base portion and the engagement portion each having substantially cylindrical complementary bearing surfaces that are engaged with one another and that are structured to enable the gear and the engagement portion to be together rotatable with respect to the handle assembly.

11. The circuit interrupter of claim 10 wherein the engagement portion comprises a number of engagement structures that are engaged with the gear.

12. A circuit interrupter comprising:

a housing;

an operating mechanism disposed on the housing; and a charging handle apparatus mechanically connected with the operating mechanism to mechanically charge the operating mechanism, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

the engagement portion comprising a number of engagement structures that are engaged with the gear; and wherein the gear has at least a pair of holes formed therein, and wherein the number of engagement structures comprise at least a pair of pins that are received in the at least pair of holes.

13. The circuit interrupter of claim 12 wherein the engagement portion comprises a substantially planar engagement surface, the pins protruding from the engagement surface, the engagement surface being engageable with a face of the gear.

14. A circuit interrupter comprising:

a housing;

an operating mechanism disposed on the housing; and a charging handle apparatus mechanically connected with the operating mechanism to mechanically charge the operating mechanism, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

the engagement portion comprising a number of engagement structures that are engaged with the gear; and wherein the operating mechanism comprises a shaft, and wherein the gear and the engagement portion each have a non-cylindrical opening formed therein, the opening in the gear and the opening in the engagement portion being aligned with one another and have received therethrough the shaft when the engagement structures are engaged with the gear in a first orientation of the gear and the engagement portion, the opening in the gear and the opening in the engagement portion being at least partially misaligned and resisting receiving the shaft therethrough when the engagement structures are engaged with the gear in a second orientation of the gear and the engagement portion different than the first orientation.

15. The circuit interrupter of claim 14 wherein the handle assembly comprises a pawl having a pawl engagement surface, and wherein the gear includes a plurality of teeth, at least some of which each have a tooth engagement surface, at least some of the tooth engagement surfaces being individually engageable with the pawl engagement surface in the first orientation of the gear and the engagement portion.

16. A circuit interrupter comprising:

a housing;

an operating mechanism disposed on the housing; and a charging handle apparatus mechanically connected with the operating mechanism to mechanically charge the operating mechanism, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

the engagement portion comprising a number of engagement structures that are engaged with the gear; and the operating mechanism comprises a shaft;

the gear and the engagement portion each have a non-cylindrical opening formed therein;

the handle assembly comprises a pawl having a pawl engagement surface;

the gear includes a plurality of teeth, at least some of which each having a tooth engagement surface; and in at most a first orientation of the engagement of the engagement structures with the gear:

the opening in the gear and the opening in the engagement portion are aligned with one another and have received the shaft therethrough, and the pawl engagement surface is engageable with individual ones of the tooth engagement surfaces and is structured to rotate the shaft to charge the operating mechanism of the circuit interrupter.

17. A circuit interrupter comprising:

a housing;

an operating mechanism disposed on the housing; and a charging handle apparatus mechanically connected with the operating mechanism to mechanically charge the operating mechanism, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

the engagement portion comprising a number of engagement structures that are engaged with the gear; and wherein the handle apparatus comprises a handle member, and wherein the engagement structures that are engaged with the gear retain the gear between at least a portion of the engagement portion and at least a portion of handle member.

18. A circuit interrupter comprising:

a housing;

an operating mechanism disposed on the housing; and a charging handle apparatus mechanically connected with the operating mechanism to mechanically charge the operating mechanism, the charging handle apparatus comprising:

a handle assembly;

a gear structured to be mechanically connected with a portion of the operating mechanism;

a support apparatus disposed on the handle assembly and engaged with the gear, the support apparatus comprising a base portion and an engagement portion, the base portion being disposed on the handle assembly, the engagement portion being disposed on the base portion and engaged with the gear, at least one of the base portion and the engagement portion being movable with respect to the other of the base portion and the engagement portion;

wherein the base portion and the engagement portion have complementary bearing surfaces that are each substantially cylindrical and that are engaged with one another; and wherein the bearing surfaces are formed to each have a draft angle from cylindrical that is no more than about one degree.

* * * * *

UNITED STATES PATENT AND TRADEMARK OFFICE

CERTIFICATE OF CORRECTION

PATENT NO. : 8,592,706 B2
APPLICATION NO. : 12/881448
DATED : November 26, 2013
INVENTOR(S) : Edward Anthony Prince et al.

It is certified that error appears in the above-identified patent and that said Letters Patent is hereby corrected as shown below:

On the Title Page, item (54) and in the Specification, Column 1, Title of the Invention, "CHARGING HANDLE APPARATUS AND SWITCHGEAR APPARATUS" should read --CHARGING HANDLE APPARATUS AND CIRCUIT INTERRUPTER--.

Signed and Sealed this
Eleventh Day of February, 2014

Michelle K. Lee

Michelle K. Lee
*Deputy Director of the United States Patent and Trademark Office*